United States Patent [19]

Bachrach et al.

[11] Patent Number: 5,030,027

[45] Date of Patent: Jul. 9, 1991

[54] SCHEDULE AND PAPERWORK ORGANIZER

[76] Inventors: Scott Bachrach, 122½ N. Gale St., Beverly Hills, Calif. 90212; Alan L. Backus, 1550 Centinela Ave. #210, Los Angeles, Calif. 90025

[21] Appl. No.: 485,884

[22] Filed: Feb. 27, 1990

[51] Int. Cl.[5] ..... B42F 13/00; B42F 13/16

[52] U.S. Cl. ..... 402/4; 281/37; 281/29; 281/51; 402/80 R

[58] Field of Search ..... 281/29, 37, 51; 402/4, 402/80 R

[56] References Cited

U.S. PATENT DOCUMENTS

| | | | |
|---|---|---|---|
| 956,230 | 4/1910 | Thompson | 251/51 X |
| 2,223,917 | 12/1940 | McGloin | 281/51 X |
| 2,302,410 | 11/1942 | Bannon | 402/4 X |
| 2,639,168 | 5/1953 | Coppock | 281/37 X |
| 2,676,019 | 4/1954 | Steinberg | 281/29 X |
| 4,294,469 | 10/1981 | Errichiello | 281/29 |

FOREIGN PATENT DOCUMENTS

| | | | |
|---|---|---|---|
| 1491042 | 5/1967 | France | 281/29 |

*Primary Examiner*—Paul A. Bell

*Attorney, Agent, or Firm*—Fleit, Jacobson, Cohn, Price, Holman & Stern

[57] ABSTRACT

A device to facilitate organization of educational and business schedules and paperwork, simultaneous with conveying varied graphic and social images. The device is a ring binder in which a time piece is mounted for easily viewing the time display. A pocket is provided on the front cover of the device for receiving and easily changing opaque and transparent imprinted sheets to alter appearance, while exposing the time display.

13 Claims, 4 Drawing Sheets

SCHEDULE AND PAPERWORK ORGANIZER

BACKGROUND—FIELD OF INVENTION

The present invention relates to devices to organize schedules and paperwork for both educational and business environments.

BACKGROUND—DESCRIPTION OF PRIOR ART

Attendance of traditional educational classes in the U.S. as well as in many foreign countries necessitates prompt attention to timeliness of class attendance as well as means for organizing class materials. Most schools use bells or buzzers to signal termination and commencement of class periods. These devices facilitate coordinated class changes, but don't communicate the approach of class terminations and commencements. Many classrooms are equipped with clocks, but these are only effective in communicating approaching termination of class periods, as they may only be viewed from within the classrooms.

Wrist watches may serve a function of communicating both class terminations and commencements, but they are expensive and may be forgotten. They have further disadvantages of being potentially damaged by students rough housing before, after and during school, as well as possibly conveying an image which might not be socially advantageous to a student trying for acceptance from his or her peers.

In a broader context, there is a need for a device assisting in organizing both schedules and paperwork. Ideally such a device should be flexible enough to convey many different outward appearance and social images, as well as allowing versatility in arranging documents and papers. Such flexibility in varying outward appearance might also include the ability to promote companies or products.

Thus what is needed is an inexpensive schedule organizer which can communicate approaching class terminations and commencements, be integral with necessary class materials, and be able to portray a variety of aesthetic and social images. From a broader view such a device should allow arrangement of schedules other than educational schedules, and facilitate organization of many types of paperwork, all while communicating many different outward appearances.

OBJECTS AND ADVANTAGES

In view of the above observations, it is an object of the present invention to provide means for communicating approaching class terminations and commencements.

It is another object of the present invention to be an integral part of necessary class materials.

It is yet another object of the present invention to be able to portray a variety of socially acceptable images.

It is still another object of the present invention to assist in organizing of many types of schedules including, but not limited to, educational and business schedules.

It is yet another object of the present invention to facilitate organization of many types of paperwork.

It is another object of the present invention to have flexibility to convey many different outward appearances including appearances which might promote companies and products.

It is another object of the present invention to allow the manufacturer of the present invention to stockpile generic inventory, and to be able to change the inventory to meet specific markets relatively inexpensively.

Readers will find further objects and advantages of the invention from a consideration of the ensuing description and the accompanying drawings.

SUMMARY OF INVENTION

The present invention relates to devices to organize schedules and paperwork for educational, business and other environments.

Each of the preferred embodiments of the invention, as disclosed, includes a time piece display affixed to or in the cover of a notebook binder with means to change the outward appearance of the notebook's cover. According to another aspect of the invention, means for altering the appearance of the time piece display as seen on the binder's cover is provided.

DETAILED DESCRIPTION OF PREFERRED EMBODIMENTS

Referring to FIGS. 1 through 3 and 8, devices are shown which are constructed in accord with the present invention each including: an outer cover 20, 22, a mounted time piece 24, 26 and a ring binder 28, 30.

Figure 1:
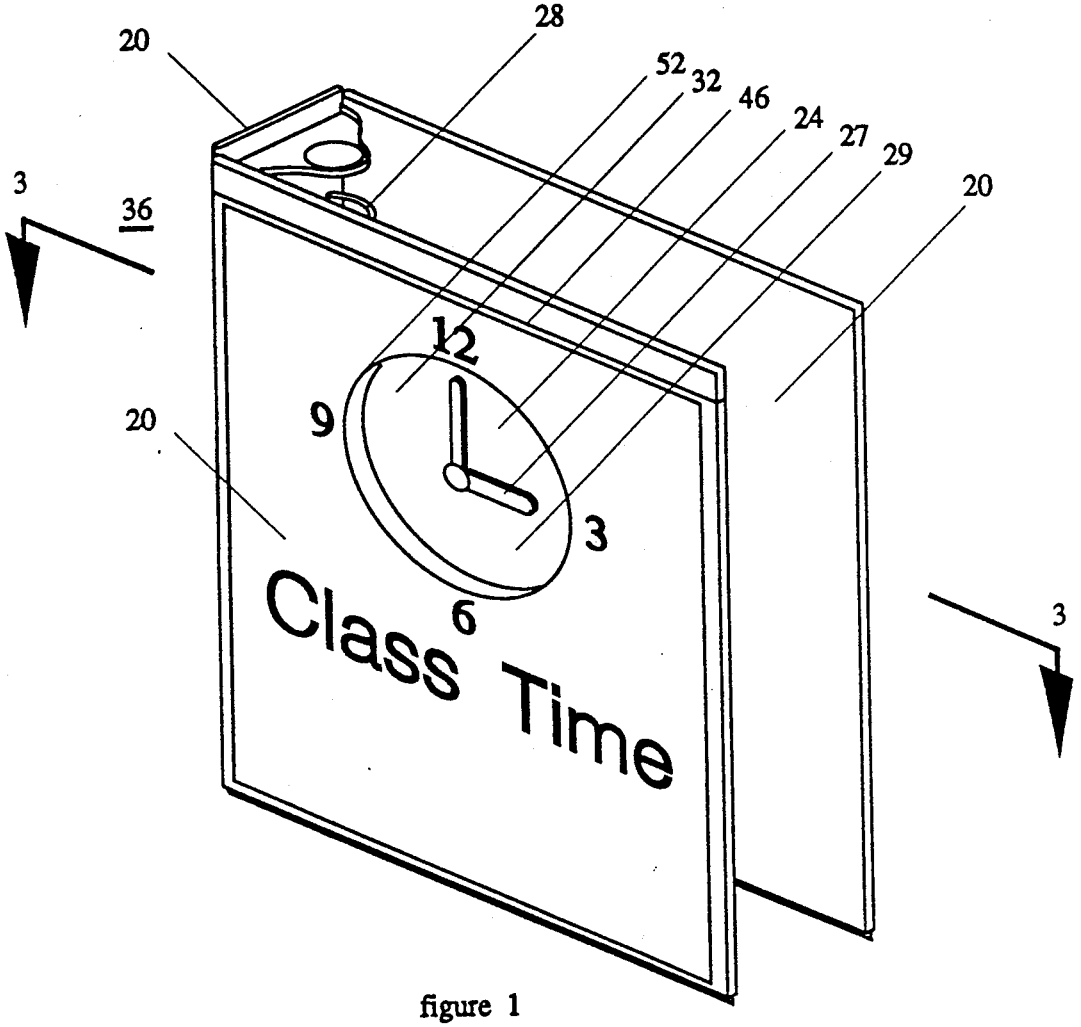
FIG. 1 shows a perspective view of a device constructed in accord with the present invention.
Figure 2:
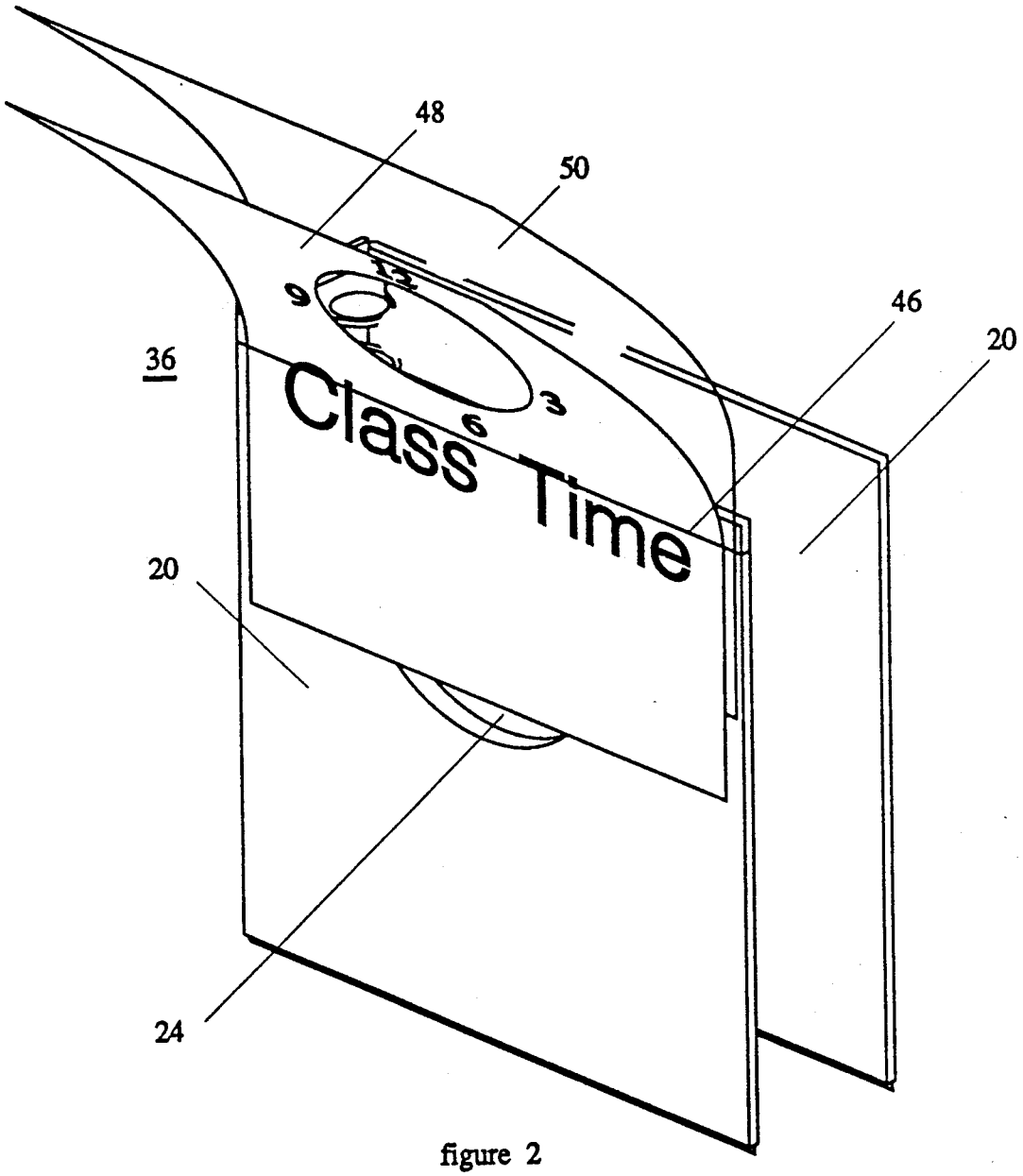
FIG. 2 is similar to FIG. 1 except showing outer graphic faces being removed from the binder's front cover.
Figure 3:
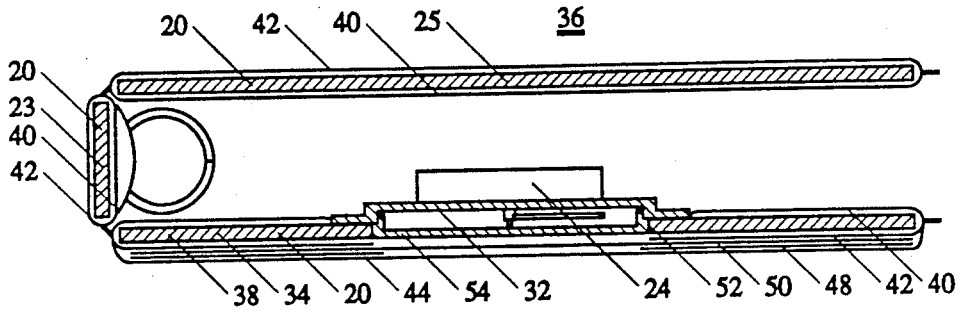
FIG. 3 is a view in section taken along line 3, 3 through FIG. 1.

Referring to FIGS. 1 through 3, a time piece 24 with an analog display 32 is shown mounted in an opening defined in front cover 34 of a ring binder notebook 36. The construction of the outer cover 20 of the ring binder notebook 36 may be of many different configurations, but is economically done with anyone of several constructions known to those knowledgeable in the art. One such construction is shown having a hinged, segmented rigid cover 20. This cover 20 contains a structural core 38 of approximately 0.125" thick solid cardboard segmented into front 34, spine 23 and back 25 sections. Each segment is surrounded by opaque vinyl sheathing 40, 42 heat sealed on all sides. The front 34 of the binder 36 has a clear outer surface or sheet 44 of vinyl (PVC), heat sealed on 3 sides but open on the top 46 to allow insertion of graphically imprinted sheets 48, 50. The top 46 is recessed or spaced down from the top 47 of the front 34 to define a pocket.

Binders of many different sizes may be used including the standard 3 ring unit shown which is designed to hold standard 8.5"×11" sheets of paper.

A hole 52 is pierced through the structural core 38 and opaque vinyl sheathing 40, 42 of the front cover 34 of the binder 36 and time piece 24 is fitted into hole 52 and secured therein via flange 53. The time piece display 32 may be viewed through the hole 52 and through the clear outer sheet or surface 44. The time piece 24 is affixed to the inside of the structural core 38 by mechanical interference, such as by flange 53 or by molded barbed fingers on its periphery engaging the structural core 38, and/or by adhesives, and/or by rivets, and/or by other known attachment means. A clear crystal 54 disposed flush with the front surface of the structural core 38 covers and protects the display 32 of the time piece 24, and may be part of piece 24.

Figure 4:
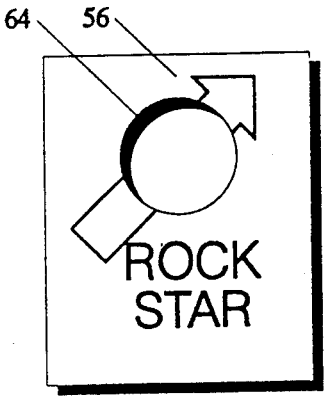
FIG. 4 and 5 show opaque graphic front face sheets which may be used in conjunction with the device portrayed in FIG. 1.
Figure 5:
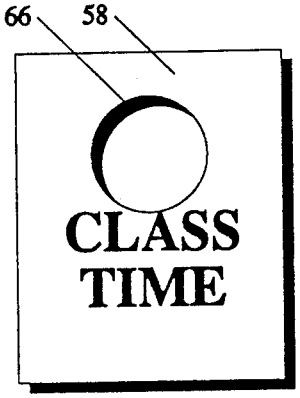
Figure 6:
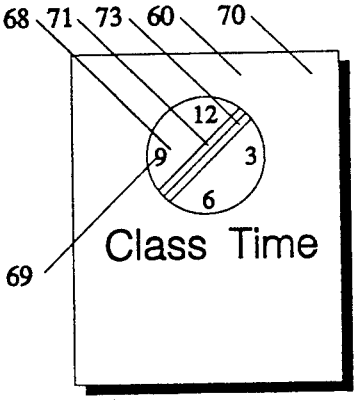
FIG. 6 shows a graphic front face sheet with both opaque 70 and tinted printed 68 sections which may be used in conjunction with the device portrayed in FIG. 1.
Figure 7:
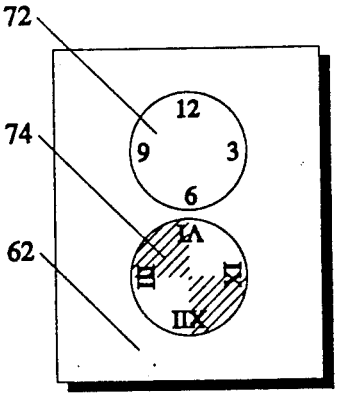
FIG. 7 shows a tinted transparent sheet 62 which may be placed behind graphic sheets shown in FIGS. 4 and 5.
Figure 8:
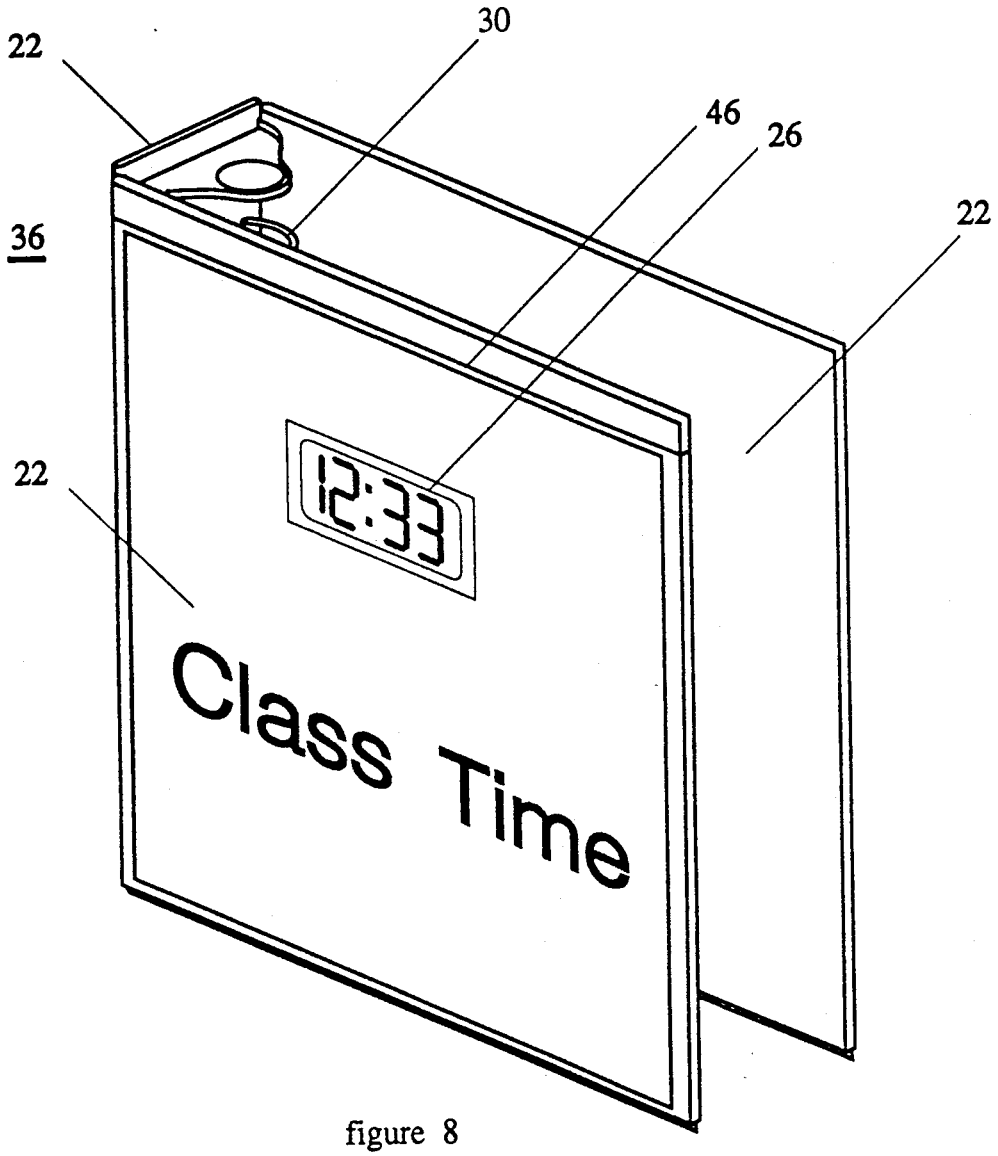
FIG. 8 shows an embodiment of the present invention using a time piece having a digital display.

FIGS. 4 through 7 show various graphic face sheets 56, 58, 60, 62 which may be positioned or located on the exterior surface of the front cover 36 by insertion through the opening 46 in the top of the clear outer sheet or surface 44 leading into the pocket created between the clear outer surface 44 and the opaque vinyl sheathing 42. Such face sheets are represented in FIGS. 2 and 3 by sheets 48 and 50. These sheets allow quick inexpensive alteration of the device's appearance by an individual sliding one or more sheets out and substituting one or more imprinted sheets 56, 58, 60, 62 in its place. FIGS. 4 and 5 show opaque sheets 56, 58 imprinted with graphics and having die cut holes 64, 66 through which the time piece display 32 may be viewed. FIG. 6 shows a graphic sheet 60 having both clear 68 and opaque 70 imprinted sections. The imprinting on the clear 68 sections may be opaque or it may provide a clear tint such as that provided by a colored theatrical lighting gel. Thus as an example, clock numerals 69 might be opaquely imprinted on the clear 68 section, while the imprinted tinting might provide red 71 and blue 73 diagonal strips across the clock's face. FIG. 7 shows an imprinted transparent sheet 62 having clock faces 72, 74 which may be placed behind the clock openings 64, 66 in the sheets 56, 58 shown in FIGS. 4 and 5. This allows varied device appearances by mixing and matching the clock faces shown in FIG. 7 with the imprinted opaque sheets 56, 58 of FIGS. 4 and 5. Imprinting may be color, or monochrome or use a variety of visual techniques such as metallized stamping, holograms, 3D prism effects etc.

The clock display 32 may have hands and background of any color, but provides best visual contrast where black and white are used such as black hands 27 against a white background 29 or vice versa. This is true whether the time piece 24, 26 has an analog face 24, such as are used by windup, and some battery powered clock mechanisms; or has a digital 26 readout. Both types of time piece displays may be altered by the graphic methods described herein.

Graphic sheets 48, 50 may contain type, photographs, and/or information such as calendars, and math and science tables etc. Space may even be provided on the graphic sheets 48, 50 for users to create their own graphics and/or enter their own information such as class schedules etc. This may include allowing the user to write on the clear outer layer 44 with a marker in spaces indicated by the graphic sheets 48, 50.

Graphic sheets may also be used to promote products, companies or services. Most important, the graphic sheets' 48, 50 overall appearance may be used to convey various images as may be important to a student attending school, such as showing popular singing groups or movie themes or other popular images. The clock appearance may also be changed, using transparent imprinted sheets 50, to convey various images such as those popularized by theme watches made by companies including Swatch (TM).

The ease with which the graphic sheets 48, 50 may be removed and inserted means communicated images and information may be changed rapidly to fit different needs. Functionality of the time piece 24, 26 is not impaired by having imprinted graphics placed around and over it. The time piece 24, 26, automatically accompanies paperwork required for school, business or other functions. Utilization of a ring binder insures flexibility in organizing such paperwork.

Thus the preferred embodiments of the invention disclosed herein accomplish the desired goals of: assisting in organizing both time and paperwork; conveying many different aesthetic and social images; allowing versatility in arranging documents and papers; being inexpensive; being able to communicate approaching class terminations and commencements; and being integral with necessary class or business or other materials.

What have been described are certain aspects of a device to facilitate organization of time and paperwork. It is understood that the foregoing descriptions and accompanying illustrations are merely exemplary and are in no way intended to limit the scope of the invention, which is defined solely by the appended claims and their equivalents. Various changes and modifications to the preferred embodiments will be apparent to those skilled in the art. Such changes and modifications may include, but are not limited to: using binders other than ring binders to organize paper work such as clamp binders, filing pockets etc.; the clear outer surface 44 being sealed on all 4 sides allowing the factory the flexibility of easily changing the outer appearance of the device, but not allowing the student or businessman to do so; piercing all cover layers to mount to time piece including piercing the clear outer layer 44; placing the time piece in a different position such as higher or lower or further left or right on the front cover, or on the back cover or on the spine; using multiple overlaid imprinted clear and opaque sheets to alter the appearance of the devices' time piece or opaque graphics; providing other locations to insert graphics, such as in the cover's back or spine; use of different size binders from note size and smaller to legal size and larger; etc.

Such changes and modifications can be made without departing from the spirit and scope of the invention. Accordingly it is intended that all such changes and modifications be covered by the appended claims and equivalents.

We claim:

1. A schedule and paperwork organizer having alterable external appearance comprising:

first retaining means for releasably retaining paper sheets, a hinged, segmented, rigid cover which when closed protects paper sheets held by said retaining means, a time piece with a display mounted in an opening formed in said cover, such that the display is clearly visible when said cover is closed, said cover having locating means for removably locating at least one imprinted sheet having at least one transparent opening in registry with and exposing said time display.

2. The organizer of claim 1 further including said imprinted sheets having imprinted markings related to said time display imprinted on said at least one imprinted sheet.

3. The organizer device of claim 2 wherein said time display is an analog time display.

4. A schedule and paperwork organizer comprising:

a ring binder for retaining and releasing paper sheets, a hinged, segmented, rigid cover having front, back and end segments which when closed protects paper sheets retained by said ring binder, a time piece having a display mounted on the inside of said rigid cover, a transparent sheet located on the exterior of the front segment of said segmented rigid cover, at least one graphic sheet disposed between said transparent sheet and said front segment of said segmented rigid cover, and at least one transparent opening in said at least one graphic sheet to register with and expose the display of said time piece when said rigid cover is closed.

5. The organizer of claim 4 further comprising said time piece having an analog display.

6. A schedule and paperwork organizer having alterable appearance comprising:

binder means for releasably holding a plurality of paper sheets, an outer cover means secured to the binder means for protecting paper sheets held by said binder means when closed, a time piece mounted on said outer cover means with its time display clearly visible when said outer cover means is closed, at least one imprinted sheet having at least one area for registering with and exposing said time display to view, and said outer cover means having locating means for locating said imprinted sheet with the area registered with and exposing the time display of the time piece to view.

7. The organizer of claim 6 wherein said at least one imprinted sheet has a transparent surface area.

8. The organizer of claim 7 wherein imprinting is disposed on said at least one imprinted sheet in said transparent surface area.

9. The organizer of claim 8 wherein said imprinting is disposed in registry with said time display.

10. The organizer of claim 6 wherein said locating means comprises a pocket with a clear outer surface that is mounted on the exterior of said outer cover means.

11. The organizer of claim 6 wherein said binder comprises a ring binder.

12. The organizer of claim 6 wherein said time piece has an analog display.

13. The organizer of claim 6 wherein said time piece has a digital display.

* * * * *